United States Patent [19]

Scheen

[11] Patent Number: 4,999,024

[45] Date of Patent: Mar. 12, 1991

[54] LEATHER TANNING PROCESS

[76] Inventor: Hansjoerg Scheen, 1710 Country Club Dr., Redlands, Calif. 92372

[21] Appl. No.: 549,541

[22] Filed: Jul. 9, 1990

Related U.S. Application Data

[63] Continuation of Ser. No. 290,177, Dec. 23, 1988, abandoned.

[51] Int. Cl.[5] ..... C14C 3/02; C14C 3/04

[52] U.S. Cl. ..... 8/94.26; 8/94.1 R; 8/94.18; 8/94.27

[58] Field of Search ..... 8/94.1 R, 94.18, 94.27, 8/94.26

[56] References Cited

U.S. PATENT DOCUMENTS 1,988,685 1/1935 Gusdorf ..... 8/94.18

*Primary Examiner*—Paul Lieberman

*Assistant Examiner*—John F. McNally

*Attorney, Agent, or Firm*—Kelly Bauersfeld & Lowry

[57] ABSTRACT

An improved leather tanning process is provided for producing leather which can be washed in water substantially without drying or cracking. The tanning process includes preliminary treatment steps during which skins are tumbled in a heated bath containing a major proportion of a combination grease/oil lubricating solution, for process times and at process temperatures to impregnate skin pores with the lubricating solution. The thus-treated skins are bated and tanned, with a preferred process including a sequence of mineral and vegetable tanning steps. Subsequent to the tanning steps, the leather skins are tumbled in a bath containing a minor proportion of the lubricating solution and other lubricating agents. The resultant leather skins are soft and compliant and retain these characteristics despite washing in water.

15 Claims, No Drawings

LEATHER TANNING PROCESS

This application is a continuation of application Ser. No. 290,177, filed Dec. 23, 1988.

BACKGROUND OF THE INVENTION

This invention relates generally to improvements in processes for tanning animal hides or skins to produce leather. More specifically, this invention relates to an improved tanning process for producing washable leather which can be washed repeatedly in water without significant degradation of desirable soft and compliant characteristics.

In general terms, tanning processes have been known for many centuries to produce leather products by dressing and preserving animal hides or skins. Such processes have been utilized in many variations to produce a wide range of useful products, such as apparel items, footwear, upholstery, sports equipment, saddlery, and many other items The particular item to be produced is related directly to the animal skin type and grade together with the specific sequence of process steps employed to obtain a desired set of physical characteristics, such as softness, compliance, durability, etc.

More specifically, in accordance with modern leather tanning processes, selected freshly split animal hides or skins are initially cured typically by salting and/or drying to prevent decay. These skins are subjected to pretanning procedures to remove loose flesh and excess hair, typically by soaking in a water bath including assisting chemical additives. The thus pretreated skins, commonly referred to as pelts, are then bated by soaking in an appropriate solution formulated to soften the pelts and further to remove excess proteins and to improve color. In some cases, fatty substances are leached out by additional soaking in solvent and/or detergent based solutions. The pelts are then chemically treated in vats with selected tanning agents of vegetable or mineral origin for conversion into leather. After tanning, the leather is frequently treated with oils or fats or other lubricating agents to obtain soft and supple characteristics, followed by appropriate dyeing, drying, and finishing.

Although leather products are used for many different types of apparel, it is well known that cleaning of dirt, stains, etc. from a leather garment can be difficult or impossible. That is, leather products have not satisfactorily retained desirable soft and compliant characteristics when wetted with water or water-based solutions of the type used for washing traditional woven fabrics. Instead, when wetted, leather products exhibit a tendency to become stiff and/or brittle when dry, with cracks or splits often occurring in response to frequent wetting. Moreover, permanent discoloration and/or stains can occur when the leather product is wetted with water. As a result, cleaning techniques for leather garments have generally been limited to relatively costly dry cleaning procedures wherein nonaqueous cleaning chemicals are used.

In the past, modified leather products have been developed to permit minor contact with water without significant adverse consequences. For example, treated suede leathers have been developed to withstand occasional surface spot cleaning with water-based solutions, with minimal change to surface characteristics or color. Other leather products have been treated during post tanning processes with specialized oil formulations to resist water penetration and damage However, prior leather products have not been developed to withstand repeated washing by full immersion in water in the manner used for cleaning traditional woven fabrics.

The object of this invention, therefore, is to provide an improved leather tanning process designed to produce a washable leather product which can be immersed and washed in water repeatedly and substantially without degradation or change in physical characteristics.

SUMMARY OF THE INVENTION

In accordance with the invention, an improved leather tanning process is provided for producing leather which can be washed repeatedly in water. The process includes a preliminary pretanning treatment step wherein animal skins or hides are impregnated with a combination grease/oil lubricating solution. The impregnated skins are then preserved by tanning to produce a soft and supple leather. Residual lubricating solution within the leather effectively maintains desired supple characteristics of the leather notwithstanding repeated washing in water.

In accordance with the preferred process corresponding with the invention, animal skins are selected for processing wherein the skins are relatively thick with a well developed pore structure. Relatively thick, aged animal skins are preferred for best results. The selected skins have been previously split and cured for processing, typically by salting and/or drying. These skins are subjected to a preliminary cleaning step including tumbling within a bath of cold water. The tumbled skins are then placed in a water-based bath containing a major proportion of the grease/oil lubricating solution designed to penetrate and impregnate the pore structure. The skins are tumbled within the lubricating solution bath while the bath is elevated in temperature, causing the pore structure of the skins to swell and thereby permit absorption of substantial quantities of the lubricating solution. Optimum results are obtained by tumbling the skins within the heated bath for an initial time period, and then allowing the skins to stand within the bath for at least several hours.

The thus-treated skins are removed from the lubricating solution bath and drained prior to a bating step including tumbling within a mild acid salt solution. Appropriate enzymes are normally added in the course of the bating step to assist in softening the skins and in removing excess proteins. The bated skins are rinsed and next subjected to tanning preparations preferably by use of a sequence of mineral and vegetable tanning steps wherein the skins are preserved to form leather having a substantially closed pore structure with the absorbed lubricating solution trapped therein. At the conclusion of the vegetable tanning step, the skins are tumbled again within a water-based solution having a minor proportion of the grease/oil lubricating solution together with additional lubricating agents to insure a soft and supple exterior surface for the leather. The resultant leather is drained and then finish processed in a normal manner.

In use, the leather produced in accordance with the invention exhibits soft and pliable characteristics. When the leather requires cleaning, the leather can be washed in water in the same manner as traditional woven fabric garments. The entrapped lubricating solution within the pore structure is substantially isolated against removal upon immersion of the leather in water or a water-based detergent solution. The entrapped lubricating solution is thus retained and is available to relubricate and soften the leather after washing.

Other features and advantages of the invention will become more apparent from the following detailed description.

DETAILED DESCRIPTION OF THE PREFERRED EMBODIMENT

A leather tanning process in accordance with the invention is provided for producing leather products which can be washed in water in the manner of traditional woven fabric materials. The improved tanning process includes a preliminary pretreatment step for impregnating animal skins or hides with a specialized combination grease/oil lubricating solution which imparts a soft and supple character to resultant tanned leather products These leather products can be washed repeatedly in water which may include conventional detergent additions. However, upon drying after a washing step, the lubricating solution beneficially relubricates and resoftens the leather substantially to its original supple characteristics, and substantially without risk of damage due to drying and cracking.

The improved leather tanning process is applicable for use with a variety of different types and grades of animal hides or skins which are known for use in making leather products In particular, the process may be used with animal skins such as cattle, pigs, sheep, fish, etc. In a preferred form, the animal skins to be processed are selected to have a relatively well developed grain or pore structure to permit absorption and entrapment of substantial quantities of the grease/oil lubricating solution. In this regard, relatively aged skins are normally preferred. For best results, animal skins to be processed should be presorted such that skins of approximately uniform density and thickness are processed together in a common batch.

In accordance with a preferred process sequence, a presorted group of generally uniform animal skins or hides are selected for processing. Such hides or skins normally have been split in a known manner to remove excessive flesh material and hair, and then appropriately cured typically by drying and/or salting to eliminate or minimize preprocessing decay. The selected skins are further cleaned as an initial step by washing and tumbling in cold water for a selected time period, typically on the order of about one-half to one hour. In some cases, this washing and tumbling step can be repeated as necessary, with intervening draining and rinsing. Such preliminary washing and tumbling step or steps are carried out using traditional tanning vats of the type having driven paddles for moving the skins within the vat.

The washed skins are next subjected to a preliminary, pretanning treatment step for impregnating the skins with the combination grease/oil lubricating solution. In general terms, this treatment step is performed by soaking and tumbling the skins in a heated bath containing a major proportion of the lubricating solution, together with sufficient chemical additives to cause the pore structure of the skins to swell and open. As a result, the skins absorb a substantial quantity of the lubricating solution.

More specifically, according to a preferred preliminary treatment step, the washed and tumbled skins are placed into a water-based bath containing a major proportion by volume of about 80% or more of the grease/oil lubricating solution. This step is accomplished either by adding the lubricating solution to the initial wash vat, or by transferring the skins to a second vat having the appropriately formulated water-based bath therein. The grease/oil lubricating solution comprises a mixture of primarily oil-based constituents including natural grease, natural soap and fish oil, together with a minor proportion of a deliming agent such as ammonium chloride which assists in swelling the pore structure of the skins. A preferred lubricating solution composition by volume is given below in Table 1.

TABLE 1

| | | |
|---|---|---|
| 1. | Natural Grease | 30% |
| 2. | Fish Oil | 40% |
| 3. | Natural Soap | 20% |
| 4. | Deliming Agent (Ammonium Chloride) | 10% |

The constituents of the lubricating solution noted in Table 1 are individually known to those skilled in the art. More specifically, the natural grease comprises any one or mixtures of glyceride or triglyceride constituents commonly present in lard oil. Fish oil in conventionally extracted from a variety of fish such as cod-liver, halibut, salmon, shark, tuna, etc. Natural soap is a mixture of sodium salts with fatty acids of various natural oils and fats. Finally, a deliming agent such as ammonium chloride is conventionally used in pretanning process steps for swelling and softening the structure of skins, while simultaneously removing lime which may be present as a result of preliminary curing of fresh animal skins.

In accordance with the preferred process of the invention, the skins or hides are immersed in the bath containing the grease/oil lubricating solution and tumbled therein for a preliminary process period on the order of one-half to one hour. During this period, the pore structure of the skins opens up to permit absorption of the lubricating solution into the interstices of the skins. The bath is then elevated in temperature to about 45°-50° C. (approximately 110°-125° F.) to achieve significant further opening of the pore structure and related additional absorption of the lubricating solution. With the bath heated, the skins are tumbled for an additional process period of about one-half to one hour. The bath and skins are then allowed to stand for further absorption of the lubricating solution through an extended time period of several hours, such as about five to eight hours. At the conclusion of the stand cycle, the skins are removed from the lubricating solution bath and drained.

The thus-processed skins are subjected to a bating process as final preparation for tanning. In the process of the present invention, this bating procedure includes tumbling the skins within a bath of cold soft water having minor amounts of acid salt deliming agents/such as ammonium chloride and ammonium sulfate. The use of soft water in this and other process steps to be described beneficially promotes a soft and silky texture to the final leather product. Preferred quantities of the deliming agents by weight are about 1.0% ammonium chloride and about 0.5% ammonium sulfate. The skins are tumbled within this bath for a process period on the order of about one-half to one hour to rinse the outside of the skins of excess lubricating solution while maintaining the pore structure open, and substantially without removing absorbed lubricating solution. The skins are then removed from this initial bating bath, drained, and then rinsed in cold water as by tumbling in a cold water bath for about one-half hour.

The bating process is continued by tumbling the treated skins in an enzyme-containing water bath for purposes of softening and conditioning the skins, and to remove any remaining protein material. Such enzyme treatment processes are generally known in the tanning art and may include, for example, tumbling the skins within a warm water bath at about 35°–40° C. (about 90°–105° F.), wherein the bath contains a minor amount (about 1–2%) of a tanning enzyme agent, such as a proteolytec enzyme concentrate of the type marketed under the name Oropon. In the preferred process, the skins are tumbled in the enzyme bath at three consecutive intervals for about ten to fifteen minutes, with intervening rest periods of about one-half hour. During this processing, the pore structure of the skins is substantially closed to entrap or seal in the absorbed lubricating solution The resultant skins, commonly referred to as pelts, are removed from the enzyme bath and rinsed by tumbling in cold water for about one-half to one hour.

At this stage, the pelts with absorbed lubricating solution are subjected to appropriate tanning agents to convert the pelts into cured, preserved leather having a desired set of soft and supple characteristics. In the preferred process, for a smooth surface finish to the final leather products, a dual tanning process is utilized to include consecutive tanning steps with mineral and vegetable tanning agents, respectively. However, it will be understood that variations in the specific tanning sequence may be employed provided significant leaching out of the absorbed lubricating solution does not occur.

More particularly, in the preferred process, the pelts are initially pretreated by tumbling in a bath of cold soft water including approximately 5–10% by weight salt (sodium chloride) for about ten to fifteen minutes. A minor amount of a chlorinated bleach compound such as hydrochloric acid (about 1–2%) is added to the bath, and tumbling of the skins in continued for an extended period of at least two to three hours followed by a prolonged rest cycle of about twelve to fifteen hours. This process step beneficially achieves further closure of the pore structure to substantially seal in the absorbed lubricating solution, while preparing the surfaces of the skin for contact with tanning agents during subsequent process steps. At the end of the rest cycle, the skins are tumbled again for a short period (about one-half hour) and the acid (pH) level is checked. If the pH reading is approximately 2.8–3.0, a mineral tanning agent such as a chromium salt is added to initiate the tanning process to convert the pelts to leather. If the pH reading is above the range of about 2.8–3.0, then the acidity of the bath is adjusted to this range before tanning agent addition.

The mineral tanning agent is desirably added in stages to the pelt bath in the course of continued tumbling movement of the pelts. For example, a quantity of about 5.0% by weight chromium salt can be divided into three equal parts and added to the bath at intervals of about one hour. If desired, the chromium salt additions may be supplemented by concurrent addition of a small quantity of a weaker tanning agent such as sodium sulfate, such as about 1–2% by weight sodium sulfate divided into three parts for addition at one hour intervals. After final addition of the chromium salt and sodium sulfate, tumbling is continued for approximately 1–2 hours, whereupon the pelts are allowed to stand and cure within the tanning bath for a prolonged time period of at least about 16–20 hours. The tanning bath is checked for acid level to determine completion of chemical tanning reactions. When the acid level is determined to be in the range of about 3.8–4.0, the resultant leather is removed from the tanning bath and drained.

The tanned leather skins are next rolled and ground in accordance with known processes to stretch each skin to substantially uniform thickness. The leather skins are then bundled and allowed to stand in air for approximately 1–2 days. Coloring dyes may be applied to the skins at this stage.

In accordance with the preferred process, the once-tanned skins are subjected to a secondary tanning step utilizing vegetable tanning agents. The use of a secondary tanning step with vegetable agents advantageously promotes a smooth and silky exterior surface texture to the finished leather goods.

More specifically, in the secondary tanning step, the leather skins are immersed in a cold water bath adjusted by addition of approximately 40% soft water. To this bath, a minor amount of a known vegetable tanning agent such as mimosa (wattle) bark (about 1.0%) is added. In addition, a minor amount (about 1.0%) of a vegetable tanning agent sold under the name Tanigan is added to enhance the tanning process, and to act as a bleaching agent for the chrome-tanned skins. The skins are tumbled in this bath for about one-half to one hour, followed by removal and draining of the leather skins.

At the conclusion of the secondary tanning step, the skins are treated a second time with the grease/oil lubricating solution together with additional lubricating agents to obtain a soft, compliant texture. In the preferred form, this lubricating step is carried out by immersing the skins in a water-based bath to which the lubricating solution and additional lubricating agents of a type generally known in the tanning industry are added. The lubricating agents are added by volume generally as noted below in Table 2.

TABLE 2

| | | |
|---|---|---|
| 1. | Natural Grease | 20% |
| 2. | Grease/Oil Lubricating Solution (See TABLE 1) | 15% |
| 3. | BFN | 2–3% |
| 4. | Olinor 11 | 2–3% |
| 5. | Fish Oil approx. | 1% |
| 6. | Formic Acid | .5–1.0% |

The re-exposure to the grease/oil lubricating solution and other lubricating agents beneficially conditions and softens the leather to a highly desirable and pleasing supple state. For best results, the skins are tumbled in this post process bath at an elevated temperature (about 45–50° C.) for about one-half to one hour. The skins are then removed from the bath and drained for final finish processing. Such finish processing typically includes partial drying in an oven and/or tumbling in an air dryer.

The resultant leather skins are adapted to undergo standard washing in water without experiencing significant adverse effects. That is, when the leather becomes soiled, the leather can be machine- or hand-washed by complete immersion in water which may contain detergent. After washing, the leather can be dried in air or tumbled in a heated air flow. In either case, sufficient lubricating solution is retained within the pore structure to recondition and relubricate the leather to a soft and supple state despite repeated washing in water.

A variety of modifications and improvements to the leather tanning process of the present invention will be apparent to those skilled in the art. Accordingly, no limitation on the invention is intended by way of the foregoing description, except as set forth in the appended claims.

What is claimed is:

1. A leather tanning process comprising the steps of:

pretreating animal skins having a natural substantially closed pore structure, said pretreating step including immersing the skins in a bath containing a lubricating solution under time and temperature conditions to result in substantial opening of the pore structure of the animal skins and absorption of a substantial quantity of the lubricating solution into the pores structure of the animal skins;

subjecting the pretreated skins to a bating process comprising:

(a) tumbling said pretreated skins in an initial bating bath comprising a mild acid solution;

(b) removing said pretreated skins from said initial bating bath;

(c) rinsing said pretreated skins in water;

(d) tumbling said pretreated skins in an enzyme-containing aqueous bath; and (e) rinsing said pretreated skins to substantially close the pore structure to seal in the absorbed lubricating solution; and tanning the bated skins to produce leather having the lubricating solution absorbed therein.

2. The leather tanning process of claim 1 wherein the lubricating solution includes lubricating agents selected from the group consisting of grease and oil.

3. The leather tanning process of claim 1 wherein the lubricating solution comprises a mixture of natural grease and oil with natural soap.

4. The leather tanning process of claim 3 wherein the lubricating solution comprises a major portion of the bath by volume.

5. The leather tanning process of claim 4 wherein the lubricating solution comprises about 80% by volume of the bath.

6. The leather tanning process of claim 3 wherein the lubricating solution comprises by volume about 30% natural grease, about 40% fish oil, about 20% natural soap, and the balance comprising a selected deliming agent.

7. The leather tanning process of claim 1 wherein said tanning step comprises consecutive tanning steps utilizing mineral and vegetable tanning agents, respectively.

8. A leather tanning process for converting animal skins to leather, said animal skins having a natural substantially closed pore structure, said process comprising the steps of:

pretreating the skins in a bath containing a major proportion of a selected lubricating solution, said pretreating step including immersing the skins in the bath and elevating the temperature of the bath to substantially open the pore structure of the skins and thereby permit absorption of a substantial quantity of the lubricating solution;

subjecting the pretreated skins to a bating process comprising:

(a) tumbling said pretreated skins in an initial bating bath comprising a mild acid solution;

(b) removing said pretreated skins from said initial bating bath;

(c) rinsing said pretreated skins in water;

(d) tumbling said pretreated skins in an enzyme-containing aqueous bath; and (e) rinsing said pretreated skins to substantially close the pore structure to seal in the absorbed lubricating solution;

tanning the skins to produce leather having the lubricating solution absorbed therein; and conditioning the exterior surfaces of the skins by contact with a selected lubricating solution.

9. The leather tanning process of claim 14 wherein said pretreating step includes elevating the bath temperature to about 45°-50° C.

10. The leather tanning process of claim 15 wherein said pretreating step includes washing the skins in the bath for about one half to one hour, elevating the temperature of the bath and continuing to wash the skins for about one-half to one hour and allowing the skins to stand in the bath for at least about five to eight hours.

11. The leather tanning process of claim 14 wherein the lubricating solution includes lubricating agents selected from the group consisting of grease and oil.

12. The leather tanning process of claim 14 wherein the lubricating solution comprises a mixture of natural grease and oil with natural soap.

13. The leather tanning process of claim 14 wherein the lubricating solution comprises by volume about 30% natural grease, about 40% fish oil, about 20% natural soap, and the balance comprising a selected deliming agent.

14. The leather tanning process of claim 14 wherein said tanning step comprises consecutive tanning steps utilizing mineral and vegetable tanning agents, respectively.

15. The leather tanning process of claim 14 wherein said conditioning step comprises washing the skins in a post tanning bath containing a minor proportion of the lubricating solution.

* * * * *